US007363798B1

(12) United States Patent
Nikkel

(10) Patent No.: US 7,363,798 B1
(45) Date of Patent: Apr. 29, 2008

(54) FLEXIBLE EXTENSION FOR PULLING TOOLS

(76) Inventor: Robert E. Nikkel, 4101 Mount Vernon Ct., Fort Collins, CO (US) 80525

( * ) Notice: Subject to any disclaimer, the term of this patent is extended or adjusted under 35 U.S.C. 154(b) by 60 days.

(21) Appl. No.: 11/386,912

(22) Filed: Mar. 22, 2006

(51) Int. Cl.
*B21D 9/05* (2006.01)
*B21J 15/16* (2006.01)

(52) U.S. Cl. ..... 72/391.2; 29/243.521; 29/243.527; 29/243.528; 29/267

(58) Field of Classification Search ..... 29/243.521–243.529, 267; 81/177.6; 72/391.2
See application file for complete search history.

(56) References Cited

U.S. PATENT DOCUMENTS 3,584,511 A * 6/1971 Collins ..... 29/267
4,653,309 A * 3/1987 Hendricks et al. ..... 72/391.2
4,876,929 A * 10/1989 Kozak ..... 81/177.6
5,185,934 A * 2/1993 Tillman ..... 30/392
5,295,290 A * 3/1994 Johnston ..... 29/243.527
5,732,606 A * 3/1998 Chiang ..... 81/177.6
6,813,975 B2 * 11/2004 Kozak ..... 81/177.6

OTHER PUBLICATIONS

Textron Aerospace Fasteners, Tool Catalog, 1999, Cherry, pp. 1-25.*
CherryTool Catalog, Textron Aerospace Fasteners, 2001; cover page, inside cover page, pp. 17-18.

* cited by examiner

*Primary Examiner*—David B Jones
(74) *Attorney, Agent, or Firm*—Marian J. Furst

(57) ABSTRACT

A flexible extension device that can be mounted between a fastener installation tool and a pulling head. The device can flex over a range up to about 45 degrees and can operate under tensile and compressive loads required for installing fasteners. It includes adapters that can mate with a desired type of installation tool and pulling head.

20 Claims, 5 Drawing Sheets

FLEXIBLE EXTENSION FOR PULLING TOOLS

FIELD OF THE INVENTION

The present invention relates generally to a flexible extension device for use with fastener installation tools, and more particularly to a flexible extension device for use with fastener installation tools that exert a pulling force on a fastener during installation.

BACKGROUND OF THE INVENTION

There are many applications within the aircraft industry and other industries where fasteners are installed into prepared openings or holes in a workpiece or workpieces using a specialized installation tool. Examples of such fasteners include lockbolts, rivets, rivetless nut plates, blind bolts, and blind rivets. Installation tools for these types of fasteners generally include an air, air-hydraulic, or other pulling mechanism that is connected to a draw bolt inside a particular pulling head that is specialized for a selected type of fastener. The installation tools and pulling heads include members that act under compression to force the pulling head against the workpiece into which the fastener is to be installed and other members, including a mechanism for gripping the fastener, that act under tension to install or up-set the fastener in the hole of the workpiece or workpieces. To facilitate use of the installation tool with different types of fasteners, the pulling head may be removable from the installation tool and interchangeable with other pulling heads.

Many situations arise, particularly during maintenance of already-built aircraft and other structures, where fasteners must be installed at locations that are not accessible with typical installation tools because the tool itself cannot fit into the space adjacent to the fastener location. Extension devices are available that fit between the installation tools and the pulling heads. Because the relatively large pulling forces and compressive forces required for fastener installation must be transmitted through the extension devices, the extension devices used to date are rigid and allow force transmission in a straight line between the installation tool and the pulling head. However, situations arise where the fastener is to be installed in a location where the installation tool equipped with a rigid extension device and pulling head does not allow proper alignment of the installation tool with the workpiece into which the fastener is to be installed.

Thus, there is a need for a flexible extension that can be inserted between an installation tool and a pulling head, yet provides for transmission of both tensile and compressive forces when the installation tool and the pulling head are in an offset alignment relative to each other.

SUMMARY OF THE INVENTION

To achieve the foregoing and other objects and in accordance with the purpose of the present invention broadly described herein, one embodiment of this invention comprises a flexible extension device for use with a fastener installation tool having a pulling head. The device comprises a flexible casing capable of withstanding compressive loads applied during fastener installation and having a proximal end and a distal end; a flexible housing disposed about the casing and having a proximal end and a distal end; a flexible pulling means within the casing and capable of withstanding tensile loads applied during fastener installation; means for coupling the proximal end of the housing to the fastener installation tool; means for coupling the distal end of the housing to the pulling head; means for joining the proximal end of the pulling means to a pulling device within the installation tool; means for joining the distal end of the pulling means to a pulling device within the pulling head; means for positioning the pulling means within the casing; and means for positioning the casing within the housing. The pulling means is reciprocally slidable lengthwise within the casing and has proximal and distal ends.

The pulling means may be selected from rods, spring-loaded cables, and combinations thereof. The means for coupling the proximal end of the housing may comprise an adapter joined to the proximal end of the housing that is mateable with the fastener installation tool. The means for coupling the distal end of the housing may comprise an adapter joined to the distal end of the housing that is mateable with the pulling head. The means for joining the proximal end of the pulling means may comprise an adapter joined to the proximal end of the pulling means that is mateable with the pulling device within the installation tool. The means for joining the distal end of the pulling means may comprise an adapter joined to the distal end of the pulling means that is mateable with the pulling device within the pulling head. The means for positioning the pulling means may be selected from bushings positioned at the proximal and distal ends of the casing, centralizer portions disposed along the pulling means, and combinations thereof. The means for positioning the casing may comprise bushings positioned at the proximal and distal ends of and coupled to the housings.

Preferably, the extension device is operable under compressive and tensile forces up to about 5,000 pounds. Preferably, the casing is operable under compressive and tensile forces up to about 2,500 pounds. The device is preferably operable with flexion to an angle up to about 15 degrees. More preferably, the device is operable with flexion to an angle up to about 20 degrees. Even more preferably, the device is operable with flexion to an angle up to about 45 degrees.

The housing may comprise a flexible material selected from polymers, urethane, and other flexible materials that are impervious to water and chemicals. Preferably, the housing is substantially impervious to water and salt. Also preferably, it is sealed to the means for joining, and the seal is substantially impervious to water and chemicals.

Another embodiment of the invention comprises a fastener installation system for installing pull-type fasteners in a workpiece. The system comprises a fastener installation tool, a pulling head, and a flexible extension device positioned between and joined to the tool and the pulling head. The flexible extension device is operable under tensile and compressive forces up to about 5,000 pounds. The flexible extension device may comprise a flexible casing capable of withstanding compressive loads applied during fastener installation and having a proximal end and a distal end; a flexible housing disposed about the casing and having a proximal end and a distal end; a flexible pulling means within the casing and capable of withstanding tensile loads applied during fastener installation, wherein the pulling means is reciprocally slidable lengthwise within the casing and has proximal and distal ends; means for coupling the proximal end of the housing to the fastener installation tool; means for coupling a the distal end of the housing to the pulling head; means for joining the proximal end of the pulling means to a pulling device within the installation tool; means for joining the distal end of the pulling means to a pulling device within the pulling head; means for positioning the pulling means within the casing; and means for positioning the casing within the housing.

Yet another embodiment of the invention comprises a fastener installation system for installing pull-type fasteners in a workpiece. The system comprises a fastener installation tool; a pulling head; and a flexible extension device. The extension device comprises a flexible pulling means, a flexible casing disposed about the pulling means and capable of withstanding compressive loads applied during fastener installation, and a flexible housing disposed about the casing.

BRIEF DESCRIPTION OF THE DRAWINGS

These and other features, aspects, and advantages of the present invention will become better understood with reference to the following description, appended claims, and accompanying drawings, where:

DESCRIPTION

The present invention comprises a flexible extension device that can be positioned between a fastener installation tool and a pulling head that engages the fastener to be installed and between a pulling device within the tool and a draw bolt or other puller device within the pulling head. Both the installation tool and the pulling head have compression portions that are under compressive forces during operation and tension portions that are movable relative to the compression portions and transmit tension forces during installation. The extension device includes flexible load-bearing means that act under tension and flexible load-bearing means that can act simultaneously under compression, along with means for engaging the proximal end of the device with the installation tool and engaging the distal end of the device with the pulling head.

Figure 1:
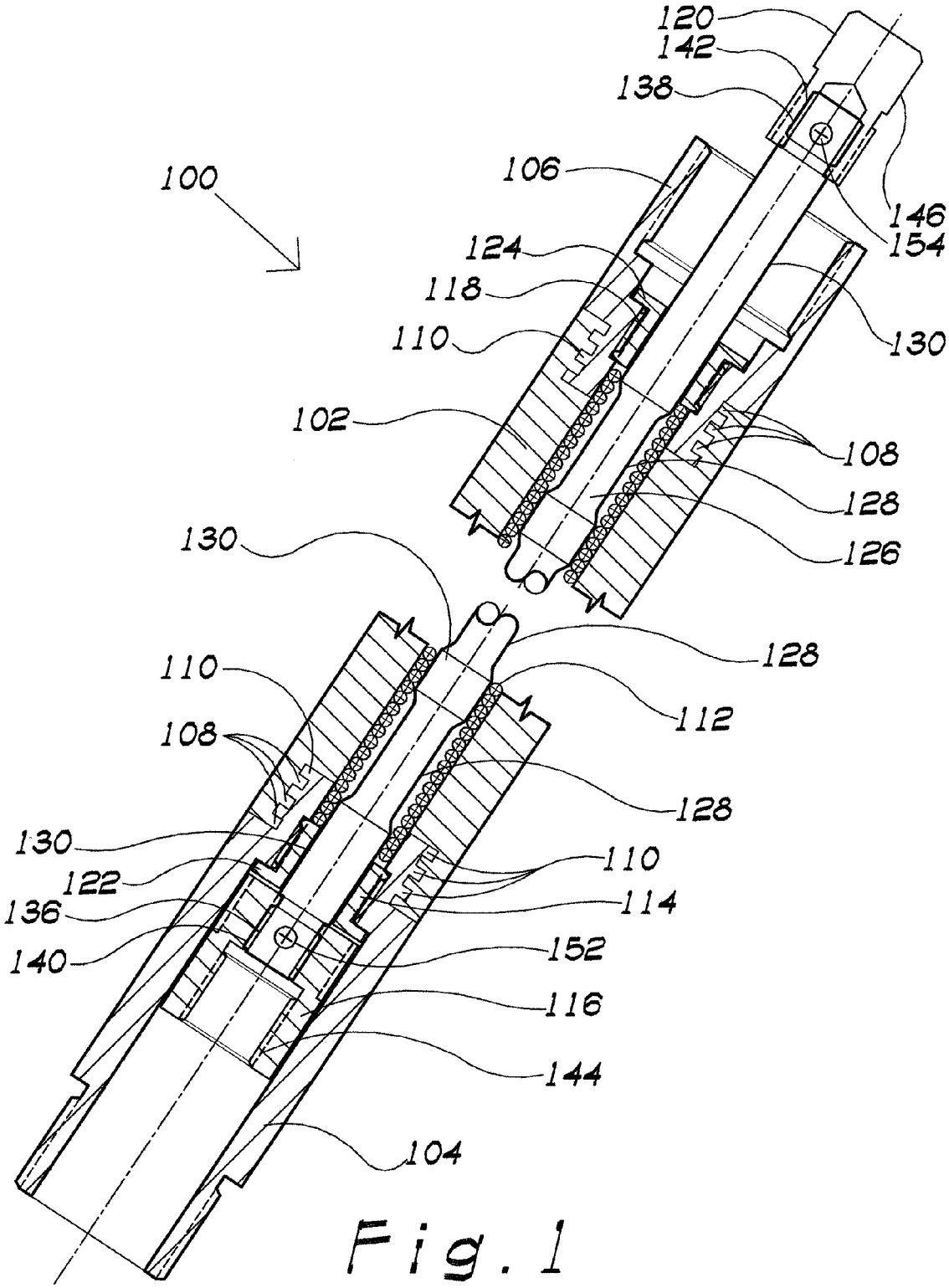
FIG. 1 is a partial cross section of one embodiment of a flexible extension device in accordance with the present invention.

One embodiment 100 of the tool of the present invention can be understood with reference to FIG. 1. The exterior flexible housing 102 is attached, preferably permanently, to proximal housing adapter 104 and distal housing adapter 106. One method of attachment is illustrated in FIG. 1, where extensions 108 mate with grooves 110 in the housing adapters. Proximal housing adapter 104 is formed such that it is engageable with the compression portion of a fastener tool, and distal housing adapter 106 is formed such that it is engageable with the compression portion of a pulling head.

Flexible casing 112 is encased within the flexible housing 102 and may comprise any material with suitable flexibility and compressive strength. The proximal end of the casing 112 butts against proximal threaded bushing 114, which is joined to housing adapter 104 via screw threads. Similarly, the distal end of the casing 112 butts against a distal threaded bushing 118, which is joined to distal housing adapter 106 via screw threads. As shown in FIG. 1, bushings 114 and 118 each include flanges 122 and 124, respectively. The bushings 114 and 118 position and stabilize the casing 112 within the flexible housing 102, preventing the casing 112 from moving relative to the housing 102.

Flexible rod 126 is positioned inside flexible casing 112. Preferably, and as shown in FIG. 1, rod 126 has a variable diameter, with one or more smaller diameter portions 128 and one or more larger diameter portions 130. The smaller diameter is selected such that the rod can withstand the tensile forces required for fastener installation while maximizing flexibility of the rod. The larger diameter is selected to centralize the rod 126 within the casing 112 while allowing rod 126 to slide reciprocally in a lengthwise direction within the casing. A proximal shaft adapter 116 at the proximal end of rod 126 is formed to mate with a puller shaft or other pulling device within a fastener installation tool, that is used to provide pulling force to the pulling head. Similarly, a distal shaft adapter 120 at the distal end of rod 126 is formed to mate with a draw bolt or other pulling device within the pulling head that applies pulling force to a fastener. The shaft adapters 116 and 120 are mounted to flexible rod 126 by any means known in the art that will function under the tensile forces to be applied. As shown in FIGS. 1-2, shaft adapters 116 and 120 include internally threaded portions 136 and 138, respectively, that engage externally threaded portions 140 and 142 of rod 126, as well as threaded portions 144 and 146 that engage with respective threaded pulling devices in the tool and the pulling head.

Flange 122 of proximal threaded bushing 114 fits within housing adapter 104, and flange 124 of distal threaded bushing 118 fits within distal housing adapter 106. If the tool extension 100 is not secured to an installation tool as discussed below, the threaded bushings may provide stops for the shaft adapters, thereby keeping the rod within the casing.

Figure 2A:
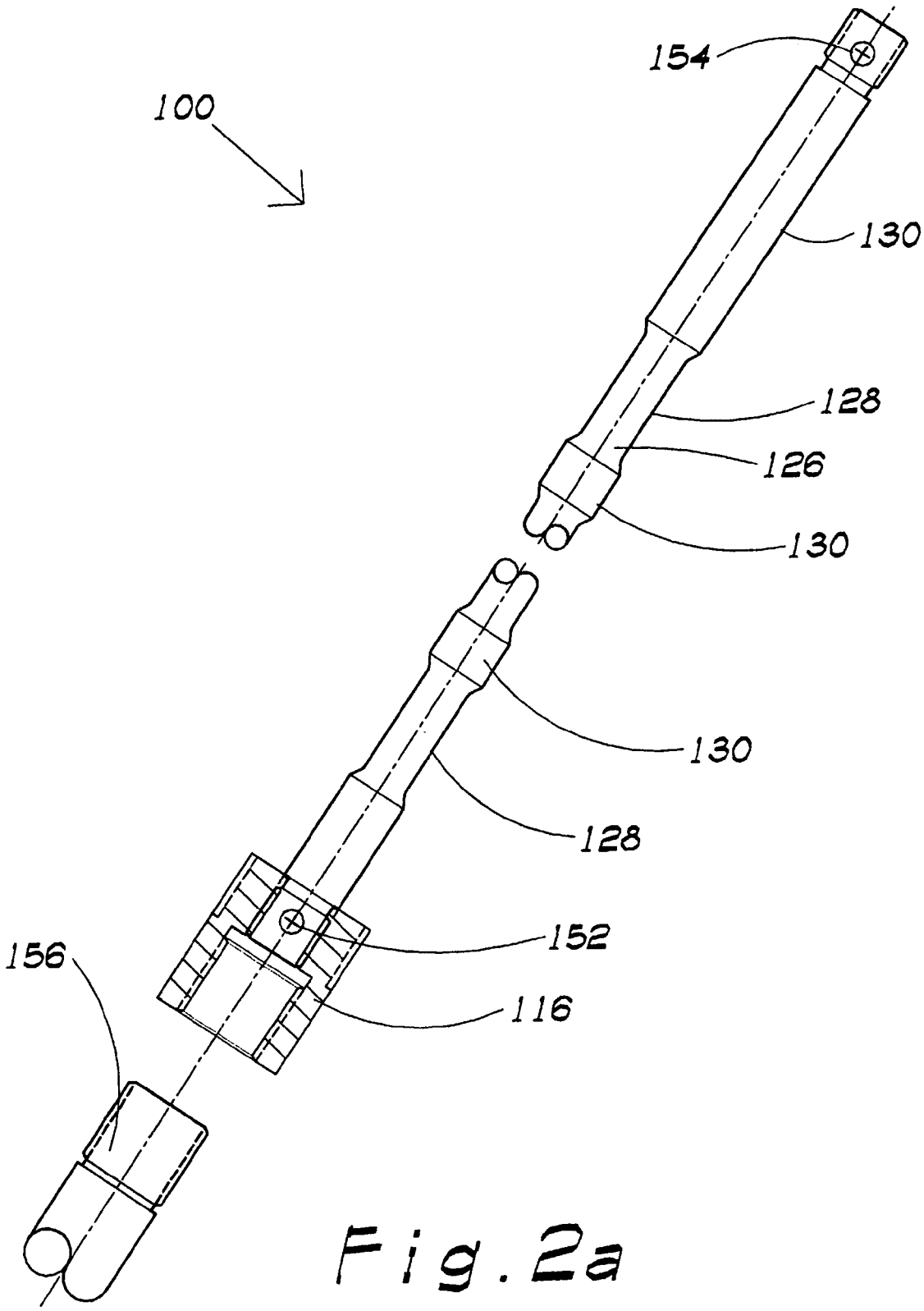
FIG. 2 is a series of partial cross sections showing the steps for assembly of the extension device of FIG. 1.
Figure 2B:
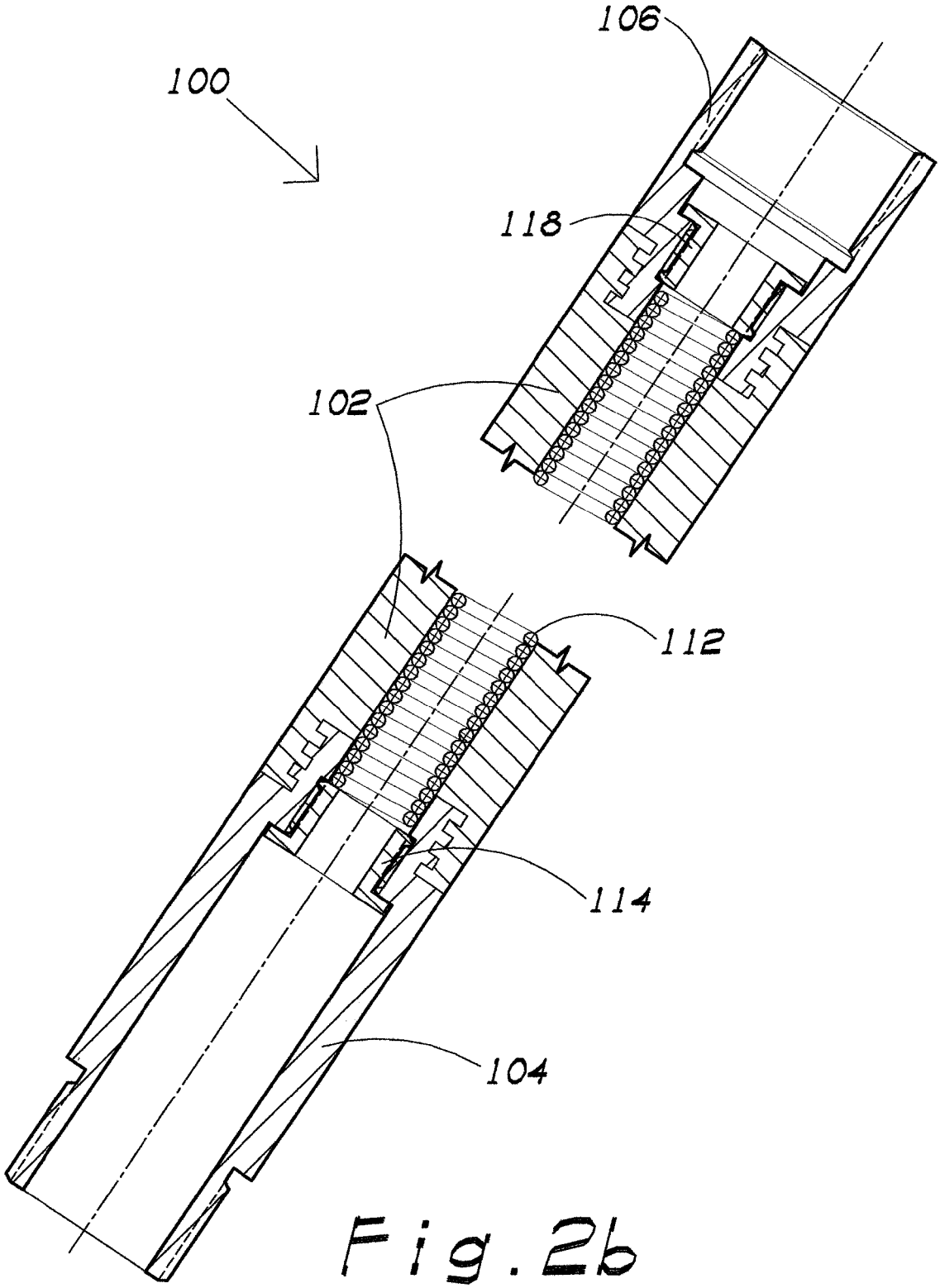
Figure 2C:
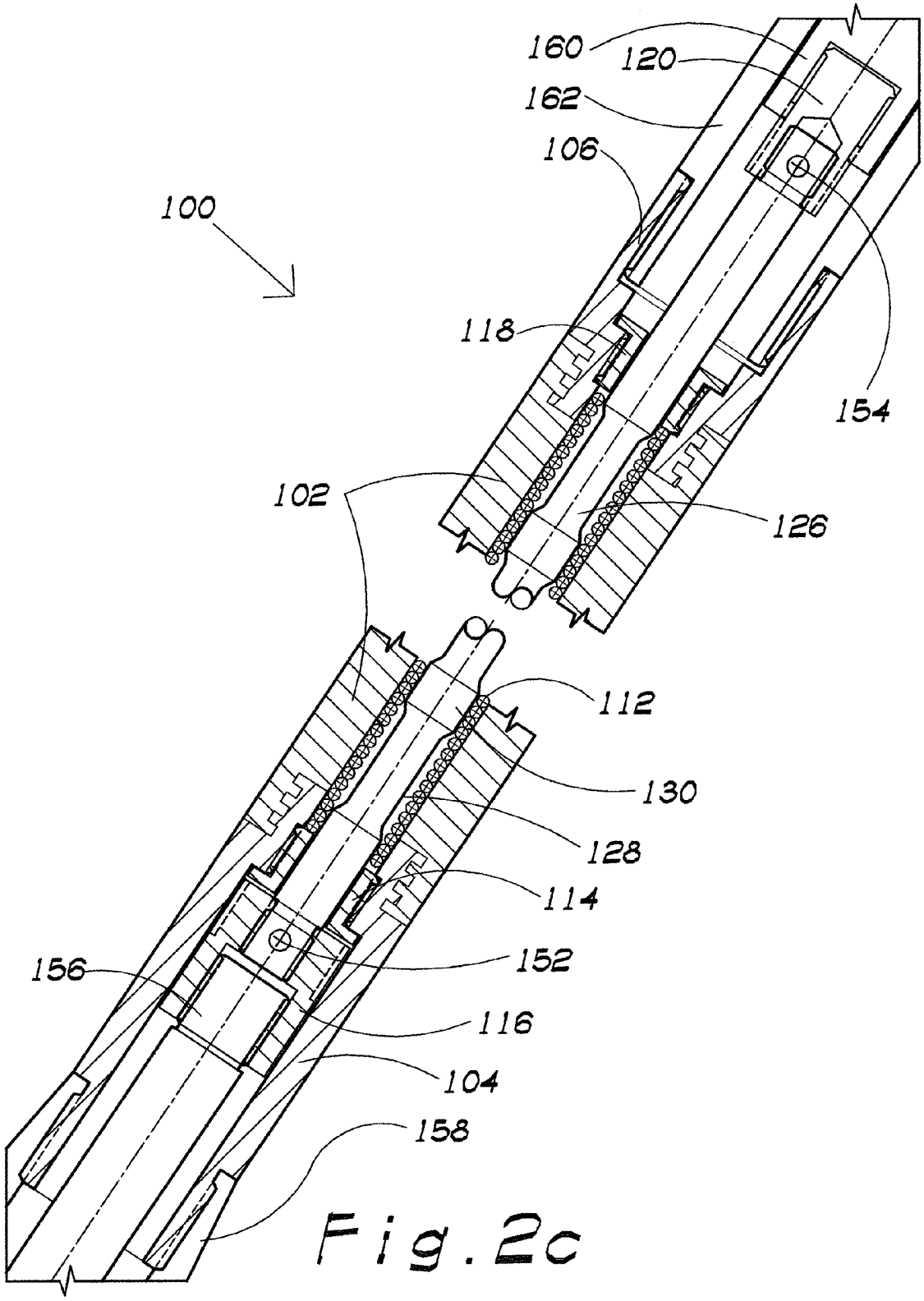

The extension device of FIG. 1 can be assembled as shown in FIG. 2. Referring to FIG. 2*a*, flexible rod 126 is formed from a length of a suitable flexible material, such as a steel alloy. The outer diameter of the rod should be slightly smaller than the inner diameter of flexible casing 112 so that the rod 126 will be able to slide reciprocally within the casing during assembly and use of the extension device. Portions 128 of the rod 126 may be machined to a smaller diameter to provide additional flexibility. The smaller diameter should be selected to provide adequate strength under the tensile forces to which it will be subjected during use. Thus, the larger diameter portions 130 of the rod 126 function as centralizers and prevent the smaller diameter sections 128 of the rod from making contact with the inside wall of the flexible casing 112, thereby reducing friction as the rod 126 slides within the casing and threaded bushings 114 and 118. Preferably, as shown in FIGS. 1 and 2, the ends of rod 126 are externally threaded and provided with pin holes 152 and 154. Referring to FIG. 2*b*, the proximal and distal housing adapters 104 and 106, respectively, are machined from a suitable alloy or other material. Then, flexible housing 102 is molded in the form of a hollow tube, the ends of which are bonded to housing adapters 104 and 106. Flexible casing 112, in the form of a spring of the desired length, is fed into the inside of the tubular flexible housing 102. Proximal threaded bushing 114 is screwed into position inside proximal housing adapter 104, and distal threaded bushing 118 is screwed into distal housing adapter 106. The threaded bushings 114 and 118 retain the flexible casing 112 within the flexible housing 102.

To assemble the extension device with an installation tool and pulling head, the proximal end of flexible rod 126 is mated to proximal shaft adapter 116. As shown in FIGS. 1 and 2, proximal shaft adapter 116 is internally threaded, and it is screwed onto the end of rod 126 and then further secured with thread adhesive and a steel pin inserted into pin hole 152. Next, shaft adapter 116 is screwed onto the end of a pulling mechanism or puller shaft 156 of an installation tool 158 that has been selected for use with the extension device, joining rod 126 to the tool 158. Flexible casing 112 and flexible housing 102 are slid into position around rod 126 from the distal end of rod 126 until proximal housing adapter 104 makes contact with the portion of the tool 158 with which it has been designed to mate. Proximal housing adapter 104 may be screwed onto tool 158, as shown, or secured by another means known in the art. Next, distal shaft adapter 120 is installed on the distal end of rod 126 by means of threads, thread adhesive, and a steel pin passing through pin hole 154. Finally, the drawbolt 160 of the desired pulling head 162 can be mounted to the distal shaft adapter 120, and the distal housing adapter 106 is joined to the pulling head 162 by means of threads, jamb nuts, adapters, or other means that are compatible with both the extension device and the pulling head. Once the pulling head is attached to the tool extension, the complete system is ready for use.

In use, a fastener is positioned with an end extending through a hole in one or more workpieces. An installation tool equipped with a tool extension in accordance with the present invention, such as extension 100, and a pulling head is mounted onto the distal end of the extension and positioned so that the pulling head engages the end of a fastener. The tool is operated in the same manner as it would be without the extension to apply tensile forces to the fastener and compressive forces to the work piece adjacent the hole into which the fastener is being installed; the rod 126 transmits the pulling force to the fastener via distal shaft adapter 120 and the draw bolt 160 or other pulling device within the pulling head 162. Simultaneously, the pulling head 162 is pushed against the work piece, and the fastener is thereby pulled into position. After the fastener is installed, the tensile force is released from the rod 126 of the tool extension, and the compressive force is released from the housing 102 via release mechanisms of the installation tool.

It should be noted that the proximal shaft adapter 116 and the proximal housing adapter 104 can be customized to mate with whatever type of tool is to be used. Similarly, distal shaft adapter 120 and distal housing adapter 106 can be customized to mate with the pulling head that is to be used.

In light of the above discussion of how the tool is assembled and used, it should be seen that the flexible housing 102 controls sideways deflection of the casing 112 and the rod 126 as well as protecting the internal portions of the device from water and chemicals. The proximal and distal threaded bushings 114 and 118 stabilize the rod 126 within the flexible casing 112, in addition to positioning the flexible casing 112 within the flexible housing 102. During fastener installation, the housing adapters 104 and 106, the flexible casing 112, and the threaded bushings 114 and 118 are subjected to compressive forces, and the shaft adapters 116 and 120 and the flexible rod 126 are subjected to tensile forces.

Figure 3:
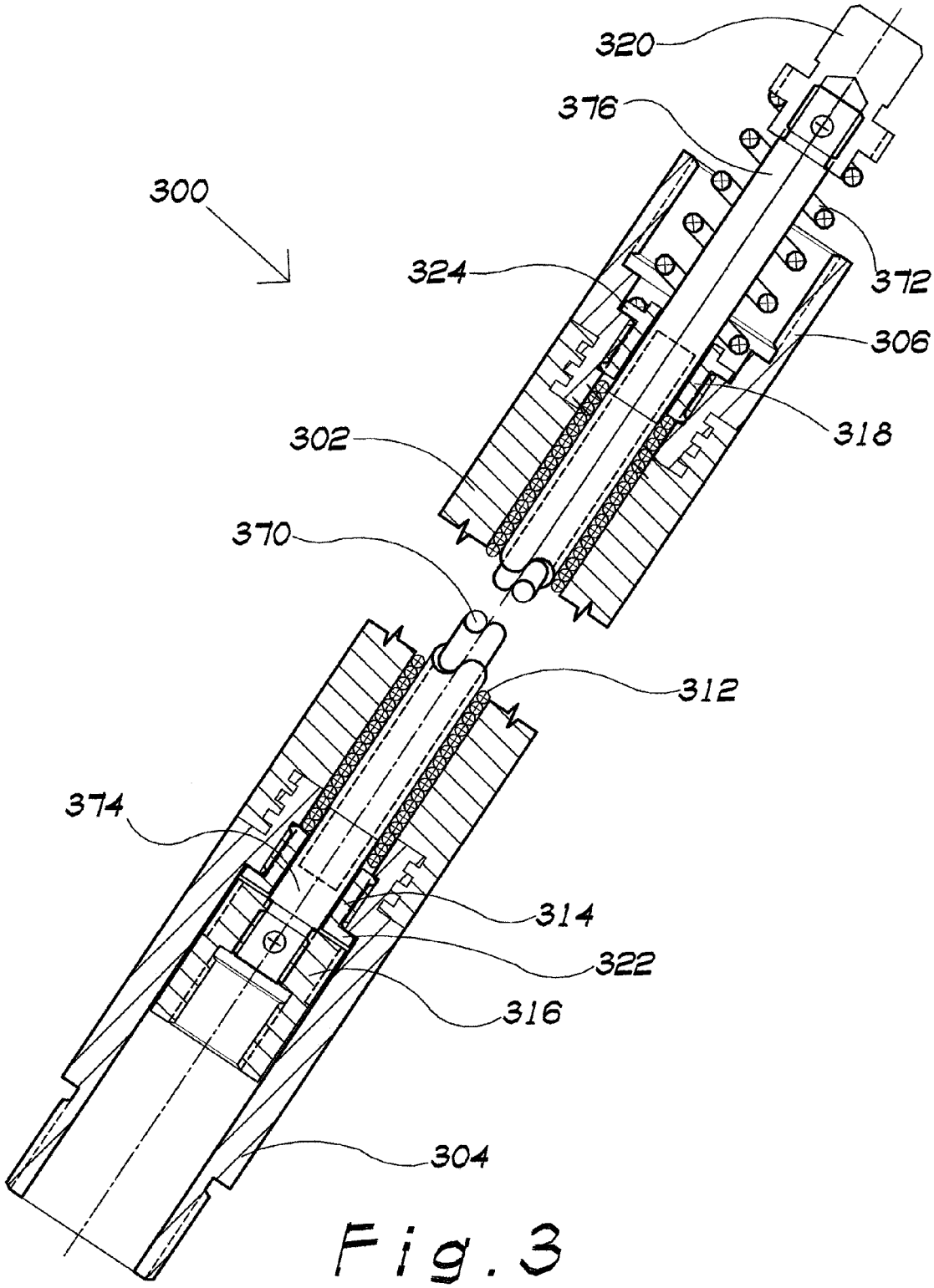
FIG. 3 is a partial cross section showing another embodiment of an extension device in accordance with the present invention.

Another embodiment 300 of the tool of the present invention can be understood with reference to FIG. 3. Extension 300 includes an exterior flexible housing 302 and a flexible casing 312, similar to the flexible housing 102 and casing 112, which are attached to proximal housing adapter 304 and distal housing adapter 306, which are similar to the housing adapters 104 and 106. Proximal housing adapter 304 is engageable with the compression portion of a fastener tool, and distal housing adapter 306 is engageable, with the compression portion of a pulling head.

Flexible casing 312 is encased within the flexible housing 302 and may comprise any material with suitable flexibility and compressive strength. The proximal end of the casing 312 butts against proximal threaded bushing 314, which is joined to housing adapter 304 via screw threads. Similarly, the distal end of the casing 312 butts against a distal threaded bushing 318, which is joined to distal housing adapter 306 via screw threads. As shown in FIG. 3, bushings 314 and 318 each include flanges 322 and 324 respectively. The bushings 314 and 318 position and stabilize the casing 312 within the flexible housing 302, preventing the casing 312 from moving relative to the housing 302.

A length of cable 370 is positioned inside flexible casing 312 and return spring 372. As used herein, the term "cable" includes any suitable type of rope or cable having suitable performance characteristics, such as tensile strength, flexibility, elasticity, and durability. The cable may comprise wire rope or another type of rope or cable material. The diameter of cable 370 should be small enough to allow it to slide easily along the length of flexible casing 312, but large enough to withstand the tensile forces to which it will be exposed during use. Cable 370 may be more flexible than the rod 126 of extension 100, thus providing greater flexibility to the extension 300 than can be obtained with a rod such as rod 126 in extension 100. The proximal end of cable 370 is permanently joined to proximal rod end 374, and the distal end of cable 370 is permanently joined to distal rod end 376. The rod ends 374 and 376 include threaded portions at their ends that engage with proximal and distal threaded shaft adapters 316 and 320, respectively. Proximal shaft adapter 316 is formed to mate with a puller shaft or other pulling device within a fastener installation tool that is used to provide pulling force to the pulling head. Similarly, distal shaft adapter 320 is formed to mate with a draw bolt or other pulling device within the pulling head that applies pulling force to a fastener. The shaft adapters 316 and 320 are mounted to rod ends 374 and 376 by means of their threaded portions, and the rod ends 374 and 376 are mounted to the cable 370 by any means known in the art that will function under the tensile forces to be applied. The cable 370 is centralized within the flexible casing 312 by any means known in the art that will withstand the applied forces and will minimize friction while protecting the cable 370 from abrasion by the interior of the flexible casing 312.

Proximal threaded bushing 314 includes a flange 322 that fits against proximal shaft adapter 316, and distal threaded bushing 318 includes a flange 324 that fits against return spring 372, located around rod end 376 of cable 370 and between distal threaded bushing 318 and distal shaft adapter 320. The threaded bushings and spring may provide stops for the shaft adapters, thereby keeping the rod within the casing. Also, flange 324 on distal threaded bushing functions to retain spring 372 between distal shaft adapter 320 and distal threaded bushing 318.

The tool extension 300 can be assembled in a manner similar to that described for extension 100, except that the rod 126 is replaced by the cable 370, and return spring 372 is positioned about the distal end of cable 370 between the distal shaft adapter 320 and the distal threaded bushing 318.

Tool extension 300 is used in the same manner as extension 100. Spring 372 functions to pull the cable 370 back to its starting position after the tensile force is released from the cable 370, thereby releasing the forces on the pulling head. The pulling head is then released from the fastener.

The flexible housing 102 or 302 preferably is formed from a flexible material that is resistant to weather and any chemicals, such as water, salt, grease, and cleaning agents, that are likely to be used near the pulling heads or installation tool. Suitable materials include flexible polymers, rubber, and the like. Urethane is one such material that is easily formed about the flexible casing and the housing adapters.

A preferred material for the flexible casing 112 or 312 is spring steel wire that is wound in spiral fashion with successive loops in contact with the previous loops such that there are no significant gaps between loops. The wire may have either a substantially rectangular, flat wound cross section or a substantially rounded cross section depending on compressive forces that are to be applied to the flexible extension device during operation.

The tool extension of the present invention is operable under tensile and compressive forces normally encountered during installation of fasteners, such as aircraft fasteners. Preferably, the extension is operable under tensile and compressive forces up to about 5,000 pounds. Because the installation of some types of fasteners, such as lockbolts, requires the application of tensile forces to the flexible casing as well as compressive forces, the casing preferably is operable under tensile and compressive forces up to about 1,500 pounds.

The tool extension preferably can operate at flexion angles up to about 15 degrees. More preferably, it can operate at flexion angles up to about 20 degrees. Even more preferably, it can operate at flexion angles up to about 45 degrees, particularly if a cable and spring are used to convey tensile forces from the installation tool to the draw bolt or pulling mechanism of the pulling head.

The fastener installation tool extension of the present invention is preferably attached permanently to a pulling tool. However, the extension may be removable and interchangeable with other extensions and/or pulling heads. If the extension is to be removed from the tool, it may be desirable to avoid using thread adhesive when attaching the shaft adapters to the pulling devices in the installation tool and the pulling head or to use a thread adhesive that does not permanently bond the shaft adapter to the tool. Similarly, the extension may be used with a variety of interchangeable pulling heads, or it may be permanently joined to a desired pulling head.

The foregoing description is considered as illustrative only of the principles of the invention. Further, since numerous modifications and changes will readily occur to those skilled in the art, it is not desired to limit the invention to the exact construction and process shown and described above. Accordingly, all suitable modifications and equivalents may be resorted to falling within the scope of the invention.

What is claimed is:

1. A flexible extension device for use with a fastener installation tool having a pulling head, said device comprising:

a flexible casing capable of withstanding compressive loads applied during fastener installation and having a proximal end and a distal end;

a flexible housing disposed about said casing and having a proximal end and a distal end;

a flexible pulling means within said casing and capable of withstanding tensile loads applied during fastener installation, wherein said pulling means is reciprocally slidable lengthwise within said casing and has proximal and distal ends;

means for coupling said proximal end of said housing to the fastener installation tool;

means for coupling said distal end of said housing to the pulling head;

means for joining said proximal end of said pulling means to a pulling device within the installation tool;

means for joining said distal end of said pulling means to a pulling device within said pulling head;

means for positioning said pulling means within said casing; and means for positioning said casing within said housing.

2. The extension device of claim 1, wherein said flexible pulling means is selected from rods, spring-loaded cables, and combinations thereof.

3. The extension device of claim 1, wherein said means for coupling said proximal end of said housing comprises an adapter joined to said proximal end of said housing that is mateable with the fastener installation tool.

4. The extension device of claim 1, wherein said means for coupling said distal end of said housing comprises an adapter joined to said distal end of said housing that is mateable with the pulling head.

5. The extension device of claim 1, wherein said means for joining said proximal end of said pulling means comprises an adapter joined to said proximal end of said pulling means that is mateable with the pulling device within the installation tool.

6. The extension device of claim 1, wherein said means for joining said distal end of said pulling means comprises an adapter joined to said distal end of said pulling means that is mateable with the pulling device within the pulling head.

7. The extension device of claim 1, wherein said means for positioning said pulling means is selected from bushings positioned at said proximal and distal ends of said casing, centralizer portions disposed along said pulling means, and combinations thereof.

8. The extension device of claim 1, wherein said means for positioning said casing comprises bushings positioned at said proximal and distal ends of and coupled to said housings.

9. The extension device of claim 1, wherein said device is operable under compressive and tensile forces up to about 5,000 pounds.

10. The extension device of claim 1, wherein said casing is operable under compressive and tensile forces up to about 1,500 pounds.

11. The extension device of claim 1, wherein said device is operable with flexion to an angle up to about 15 degrees.

12. The extension device of claim 1, wherein said device is operable with flexion to an angle up to about 20 degrees.

13. The extension device of claim 1, wherein said device is operable with flexion to an angle up to about 45 degrees.

14. The extension device of claim 1, wherein said housing is substantially impervious to water and salt.

15. The extension device of claim 1, wherein said housing is sealed to said means for joining, and the seal is substantially impervious to water and chemicals.

16. The extension device of claim 1, wherein said housing comprises a flexible material selected from polymers, urethane, and other flexible materials that are impervious to water and chemicals.

17. A fastener installation system for installing pull-type fasteners in a workpiece, said system comprising:

a fastener installation tool;

a pulling head; and a flexible extension device positioned between and joined to said tool and said pulling head, wherein said extension device is operable under tensile and compressive forces up to about 5,000 pounds.

18. The fastener installation system of claim 17, wherein said flexible extension device comprises:

a flexible casing capable of withstanding compressive loads applied during fastener installation and having a proximal end and a distal end;

a flexible housing disposed about said casing and having a proximal end and a distal end;

a flexible pulling means within said casing and capable of withstanding tensile loads applied during fastener installation, wherein said pulling means is reciprocally slidable lengthwise within said casing and has proximal and distal ends;

means for coupling said proximal end of said housing to the fastener installation tool;

means for coupling a said distal end of said housing to the pulling head;

means for joining said proximal end of said pulling means to a pulling device within said installation tool;

means for joining said distal end of said pulling means to a pulling device within said pulling head;

means for positioning said pulling means within said casing; and means for positioning said casing within said housing.

19. A fastener installation system for installing pull-type fasteners in a workpiece, said system comprising:

a fastener installation tool;

a pulling head; and a flexible extension device comprising a flexible pulling means, a flexible casing disposed about said pulling means and capable of withstanding compressive loads applied during fastener installation, and a flexible housing disposed about said casing.

20. The fastener installation system of claim 19, wherein said extension device is operable under tensile and compressive forces up to about 5,000 pounds.

* * * * *